United States Patent [19]

Welch et al.

[11] Patent Number: 4,936,865

[45] Date of Patent: Jun. 26, 1990

[54] CATALYSTS AND PROCESSES FOR FORMALDEHYDE-FREE DURABLE PRESS FINISHING OF COTTON TEXTILES WITH POLYCARBOXYLIC ACIDS

[75] Inventors: Clark M. Welch, Metairie; Bethlehem K. Andrews, New Orleans, both of La.

[73] Assignee: The United States of America as represented by the Secretary of Agriculture, Washington, D.C.

[21] Appl. No.: 335,346

[22] Filed: Apr. 10, 1989

Related U.S. Application Data

[62] Division of Ser. No. 207,461, Jun. 16, 1988, Pat. No. 4,820,307.

[51] Int. Cl.[5] ..... D06M 13/00

[52] U.S. Cl. ..... 8/120; 8/127.1; 8/116.1; 536/32

[58] Field of Search ..... 8/120, 127.1; 536/32

[56] References Cited

U.S. PATENT DOCUMENTS 3,575,960 4/1971 Tesoro ..... 8/120

*Primary Examiner*—Paul Lieberman
*Assistant Examiner*—John F. McNally
*Attorney, Agent, or Firm*—M. Howard Silverstein; John D. Fado

[57] ABSTRACT

Catalysts for the rapid esterification and crosslinking of fibrous cellulose in textile form by polycarboxylic acids at elevated temperatures are disclosed. The catalysts are acidic or weakly basic salts selected from the alkali metal dihydrogen phosphates and alkali metal salts of phosphorous, hypophosphorous, and polyphosphoric acids. Suitable polycarboxylic acids include saturated, unsaturated and aromatic acids, as well as alpha-hydroxy acids. The textiles so treated exhibit high levels of wrinkle resistance and smooth drying properties durable to repeated laundering in alkaline detergents, and do not contain or release formaldehyde.

26 Claims, No Drawings

CATALYSTS AND PROCESSES FOR FORMALDEHYDE-FREE DURABLE PRESS FINISHING OF COTTON TEXTILES WITH POLYCARBOXYLIC ACIDS

This application is a division of Ser. No. 207,461, filed 6/16/88, now U.S. Pat. No. 4,820,307.

BACKGROUND OF THE INVENTION

1. Field of the Invention

This invention relates to new esterification catalysts and esterification processes for crosslinking cellulose as a means of imparting wrinkle resistance and smooth drying properties to cellulosic textiles without the use of formaldehyde or derivatives that release formaldehyde.

2. Description of the Prior Art

There are numerous commercial processes for imparting wrinkle resistance, shrinkage resistance and smooth drying properties to cotton fabrics and garments, so that they retain their dimensions, smooth appearance and normal shape while in use and also when machine washed and tumble dried. In most of these processes, formaldehyde or an addition product of formaldehyde is applied to the cotton textile together with an acid catalyst, and heat is then applied to produce crosslinking of the cotton cellulose molecules.

The crosslinks thus formed in the cellulose impart to the fabric a tendency to return to its original shape and smoothness when deformed by mechanical forces temporarily exerted on the fabric during its use or during laundering and tumble drying.

Formaldehyde addition products with urea, cyclic ureas, carbamate esters or with other amides are widely used crosslinking agents for durable press finishing, as the above wrinkle resistant, smooth drying treatments are called. The formaldehyde addition products, also known as N-methylol agents or N-methylolamides, are effective and inexpensive, but have serious disadvantages. They continuously release vapors of formaldehyde during durable press finishing of cotton fabric, subsequent storage of the treated fabric, manufacture of the resulting garment, retailing of the garment, and finally during use of the garment or textile by the consumer. The irritating effect of formaldehyde vapor on the eyes and skin is a marked disadvantage of such finishes, but more serious is the knowledge that formaldehyde is a carcinogen to animals and apparently also to humans continuously exposed to formaldehyde vapor for very long periods. A need is evident for durable press finishing agents and processes that do not require formaldehyde or its unstable derivatives.

Another disadvantage of the use of N-methylol agents in durable press treatments is that Lewis acid catalysts and high temperatures are required to bring about sufficiently rapid crosslinking of the cotton cellulose by such finishing agents. The Lewis acid catalysts cause undesirable losses of breaking and tearing strength in cotton fabric during the heat curing step. The strength losses are due to degradation of cellulose molecules by the Lewis acid catalysts at elevated temperature. Such strength losses occur over and above the adverse effects on strength of the crosslinkages produced in the cellulose. An added disadvantage of certain nitrogenous finishes is their tendency to retain chlorine from chlorine bleaches, with resultant fabric discoloration and strength loss if subsequently given a touch-up ironing.

The use of polycarboxylic acids with or without catalysts in pad, dry and cure treatments to impart wrinkle resistance to cotton fabric was studied by Gagliardi and Shippee, *American Dyestuff Reporter* 52, P300–P303 (1963). They observed small increases in fabric wrinkle resistance after relatively long periods of heating, and noted larger fabric strength losses than are obtained with formaldehyde-based crosslinking agents. These excessive strength losses and the low yield of crosslinkages were attributed to the long heat curing times needed with the inefficient catalysts then available.

A more rapid and effective curing process for introducing ester crosslinks into cotton cellulose was described by Rowland et al. *Textile Research Journal* 37, 933–941 (1967). Polycarboxylic acids were partially neutralized with sodium carbonate or triethylamine prior to application to the fabric in a pad, dry and heat cure type of treatment. Crosslinking of cellulose was obtained whenever the polycarboxylic acid contained three or more carboxyl groups suitably located in each molecule. With certain polycarboxylic acids, a useful level of wrinkle resistance was imparted. The conditioned wrinkle recovery angle was measured before and after five laundering cycles, and was found to decrease somewhat as a result of laundering, even though no loss of ester groups was detected. Neutralization of carboxyl groups with 2% sodium carbonate even at room temperature caused a 30% loss of ester groups. This indicates a lack of durability of the finish to alkaline solutions such as solutions of alkaline laundering detergents. The curing time needed in fabric finishing was moreover too long to permit high speed, mill-scale production.

Subsequently it was shown by Rowland and Brannan, *Textile Research Journal* 38. 634–643 (1968), that cotton fabrics given the above cellulose crosslinking treatment with polycarboxylic acids were recurable. Creases durable to 5 laundering cycles could be put into the fabrics by wetting the latter, folding, and applying a heated iron. Evidence was obtained that the ester crosslinkages are mobile under the influence of heat, due to a transesterification reaction taking place between ester groups and adjacent unesterified hydroxyl groups on cotton cellulose.

These findings were elaborated by Rowland et al. U.S. Pat. No. 3,526,048. Sodium carbonate or triethylamine were again the examples of bases used to partially neutralize the polycarboxylic acid subsequently applied as the cellulose crosslinking agent. Rowland et al defined their process as requiring neutralization of 1% to 50% of all carboxylic acid functionality by a .strong base. selected from the group consisting of alkali metal hydroxides, carbonates, bicarbonates, acetates, phosphates and borates, prior to impregnating the fibrous cellulose with the aqueous polycarboxylic acid and heating to induce crosslinking. A strong base selected from the group consisting of ammonia and certain amines also was indicated as suitable for the partial neutralization of the polycarboxylic acid.

Stated limitations of the process of Rowland et al are that the process cannot be conducted with acids of fewer than three carboxyl groups per molecule, or with acids containing olefinic unsaturation or hydroxyl groups. The reasons were lack of reaction with cellulose and lack of effective crosslinking of cellulose chains for development of high levels of wrinkle resistance. The limited durability of the finishes noted above was also a disadvantage, and the time required for complete curing was too long to permit practical rates of cloth finishing.

SUMMARY OF THE INVENTION

This invention provides rapid processes for durably imparting to fibrous cellulosic material, such as cotton and other cellulosic textiles, a high level of wrinkle resistance and smooth drying properties by means of non-nitrogenous cellulose crosslinking agents, without the use of formaldehyde or derivatives that release formaldehyde, and with less loss of tearing strength and breaking strength than produced by conventional N-methylolamides.

The present invention consists of reacting a polycarboxylic acid with the fibrous cellulosic material in the presence of a particular curing catalyst at elevated temperature. The material is impregnated with a treating solution containing the polycarboxylic acid and the curing catalyst after which the material is heat cured to produce esterification and crosslinking of the cellulose with the polycarboxylic acid. In a preferred embodiment, the process is carried out as a pad, dry and heat cure procedure with the drying and heat curing done either consecutively or simultaneously.

Curing catalysts suitable for this process are alkali metal salts of phosphorus-containing acids which include phosphorous acid, hypophosphorous acid, and polyphosphoric acids. Most of the curing catalysts are weak bases, since they are alkali metal salts of acids stronger than ortho-phosphoric acid. Also included as special purpose acidic curing catalysts are the alkali metal dihydrogen phosphates.

Polycarboxylic acids suitable as cellulose crosslinking agents for the process of the present invention are aliphatic, alicyclic and aromatic acids which contain at least three and preferably more carboxyl groups per molecule and are either olefinically saturated or unsaturated, or aliphatic, alicyclic and aromatic acids having two carboxyl groups per molecule with a carbon-carbon double bond present alpha, beta to one or both carboxyl groups. In the case of aliphatic and alicyclic acids, at least two of the carboxyl groups must be separated by only 2 to 3 carbon atoms on the chain or ring. In the case of aromatic acids, a carboxyl group must be ortho to a second carboxyl group. Also suitable are aliphatic acids containing three or more carboxyl groups per molecule and having a hydroxyl group present on a carbon atom attached to one of the carboxyl groups.

The main object of the present invention is to provide a process for improving the wrinkle resistance, shrinkage resistance and smooth drying properties of cellulosic fiber-containing textiles without the use of formaldehyde or agents that release formaldehyde.

A second object of the present invention is to provide a non-nitrogenous durable press finish for cellulosic fiber textiles in which the level of smooth drying performance, wrinkle resistance and shrinkage resistance imparted is comparable to that obtained with nitrogenous durable press finishing agents such as N-methylol agents.

A third object of the present invention is to provide a durable press process producing less tearing and breaking strength loss in the cellulosic textile than is produced by an N-methylol agent at a given level of wrinkle resistance and durable press performance imparted.

A fourth object is to provide a wrinkle resistant and smooth drying fabric of polycarboxylic acid-esterified cellulosic fiber, such as cotton, that retains its durable press properties after repeated laundering with alkaline detergents at elevated wash temperatures.

A fifth object is to provide esterification catalysts giving sufficiently rapid esterification and crosslinking of cellulosic fiber by polycarboxylic acids to permit practical rates of durable press finishing of cellulosic fiber-containing fabrics at cure temperatures below the scorch temperature of the cellulose.

A sixth object is to provide odor-free durable press finishes for cellulosic fiber-containing fabric that also impart thermal recurability, soil release properties and an affinity for basic or cationic dyes to the cellulosic fabric.

DESCRIPTION OF THE PREFERRED EMBODIMENTS

The present invention is applicable to fibrous cellulosic material containing not less than 30% by weight of cellulosic fibers including cotton, flax, jute, hemp, ramie and regenerated unsubstituted wood celluloses such as rayon. The disclosed process may be applied to fibrous cellulosic material in the form of woven and non-woven textiles such as yarns and woven or knit fabrics, and to fibers, linters, roving, slivers, or paper. The disclosed process is most advantageous with textiles containing 50%–100% cotton.

The present invention is based on the discovery that several classes of alkali metal salts of phosphorus-containing acids have a greater accelerating effect on the esterification and crosslinking of cellulose by polycarboxylic acids than is produced by the strong base catalysts used in prior art processes. Since the curing catalysts of the present invention are in most instances weak bases or even acidic salts, their greater effect in speeding the desired crosslinking of the cellulose in a fabric indicates new mechanisms of catalysis, which are not operative in the simple neutralization of a portion of the carboxyl groups of the polycarboxylic acid by a strong base acting as a buffering agent. Moreover the greater laundering durability of the fabric finishes of the present invention also demonstrates the operation of new principles.

The most active and effective curing catalysts of this invention are alkali metal hypophosphites, which in anhydrous form have the formula $MH_2PO_2$ where M is an alkali metal atom. The mechanism of the catalysis is unknown. It is hypothesized that during the heat cure, the polycarboxylic acid forms cyclic anhydrides which then add to the alkali metal hypophosphite to form acylphosphinates, $(HOOC)_xR[C(O)P(O)(H)OM]_x$ where X is an integer from 1 to 3 equal to the number of cyclic anhydride rings that have formed and reacted with the alkali metal hypophosphite, and R represents the structure of the polycarboxylic acid molecule joined to the anhydride rings transitorily formed. The hypothetical acylphosphinates so formed may react with cellulose to yield the desired crosslinked esters of the polycarboxylic acid, and regenerate the alkali hypophosphite catalyst.

Experimentally it is found that the catalyst is effective at concentrations as low as 0.3% by weight in a treating bath, but the durability of the finish is greatest at higher concentrations. A concentration range of 0.3%–11% is operable.

The weight gains of the fibrous cellulosic material are larger than accounted for by the polycarboxylic acid and any auxiliary agents such as fabric softeners that are applied. It is evident some of the curing agent is bound to the cellulose.

The alkali metal hypophosphites are effective even with a crosslinking agent such as maleic acid which has only two carboxyl groups per molecule. It is possible two molecules of maleic acid add to one molecule of alkali metal hypophosphite to yield a tetracarboxylic acid that is the actual cellulose crosslinking agent.

A second class of curing catalysts employed in the present invention are alkali metal phosphites having the formula $MH_2PO_3$ and $M_2HPO_3$. These are nearly as active as alkali metal hypophosphites, but the durable press finishes obtained by their use are slightly less durable to laundering. Their mode of action is not known, but it is possible the polycarboxylic acid on heat curing forms cyclic anhydrides which may react with the alkali metal phosphites to form acylphosphonates $(HOOC)_xR[C(O)P(O)(OH)OM]_x$ and $(HOOC)_xR[C(O)P(O)(OM)_2]_x$ where X and R are defined as above, and X has integral values of 1–3. The hypothetical intermediate so formed may react with cellulose to form the desired crosslinked esters of the polycarboxylic acid, and regenerate the alkali metal phosphite catalyst.

The concentrations of alkali metal phosphites effective in accelerating the desired cellulose crosslinking are in the range of 0.3%–11% by weight in the treating solution. For dibasic phosphite salts, however, it is preferable that the molar concentration of the catalyst does not exceed 65% of the normality of the polycarboxylic acid in the treating bath used to impregnate the cellulosic fiber-containing material.

A third class of curing catalysts employed in the processes of the present invention are the alkali metal salts of polyphosphoric acids. These are condensed phosphoric acids and encompass the cyclic oligomers trimetaphosphoric acid and tetrametaphosphoric acid, and acyclic polyphosphoric acids containing 2 to 50 phosphorus atoms per molecule including pyrophosphoric acid. Specific examples of effective catalysts in this class are disodium acid pyrophosphate, tetrasodium pyrophosphate, pentasodium tripolyphosphate, the acyclic polymer known as sodium hexametaphosphate, and the cyclic oligomers sodium trimetaphosphate and sodium tetrametaphosphate. These catalysts lead to finishes having the same initial durable press performance as the most effective prior art catalysts, but with greater durability to repeated laundering of the treated textile with alkaline detergents. The catalyst normality as a base should preferably not exceed 80% of the normality of the polycarboxylic acid in the treating bath. Effective catalyst concentrations fall in the range of 0.3–11% by weight in the treating bath.

The mechanism of the curing action of alkali metal salts of condensed phosphoric acids is not known, but it is proposed here that such salts, being in all cases the salts of anhydrides of orthophosphoric acid, have the ability to react at elevated temperature with the polycarboxylic acid used as the cellulose crosslinking agent, to form mixed carboxylic-phosphoric or carboxylic-polyphosphoric anhydrides which subsequently react with cellulose to form the desired crosslinked ester of the polycarboxylic acid with the cellulose of the fibrous material, along with a moderate amount of phosphorylated cellulose as a co-product. The latter in the form of the alkali metal salt is anionic, and would result in a greater negative charge in the substituted cellulose. This negative charge would repel negatively charged anions of the alkaline detergent as well as any hydroxyl ions present, thereby decreasing the rate of alkaline hydrolysis of the ester crosslinks during laundering.

A fourth class of curing catalysts suitable in special cases in the processes of the present invention are the alkali metal dihydrogen phosphates such as lithium dihydrogen phosphate, sodium dihydrogen phosphate and potassium dihydrogen phosphate. Use of these acidic curing agents with polycarboxylic acids in durable press finishing of cellulosic fiber-containing fabrics leads in some cases to moderately higher fabric strength losses than the other curing catalysts described above, especially at cure temperatures of 180° C. or higher. Moreover, the degree of whiteness initially obtained in the treated fabric is less satisfactory. The use of a hot water rinse on the treated fabric improves the whiteness however. Use of these curing agents imparts a higher level of durable press properties and a higher degree of durability of the finish to laundering than is obtainable with the prior art catalysts. Concentrations of the alkali metal dihydrogen phosphates suitable for this process are 0.3–11% by weight in the treating bath. As stated by Kirk-Othmer, Encyclopedia of Chemical Technology, Third Edition, vol. 17. pp 428, 430, sodium dihydrogen phosphate is an acidic salt and in aqueous solution produces a pH of about 4.6. It is evidently different in its mode of action from the strong base curing agents required for the prior art process of Rowland et al, U.S. Pat. No. 3,526,048. Disodium hydrogen phosphate in aqueous solution gives a pH of about 9.0, according to Kirk-Othmer, and trisodium phosphate produces a pH of 11.7. It is hypothesized here that alkali metal dihydrogen phosphates are the most effective curing agents of the simple ortho-phosphates by virtue of furnishing simultaneous acid catalysis and weak base catalysis of the desired esterification and crosslinking of cellulose by polycarboxylic acids.

The processes of the present invention are carried out by first impregnating the fibrous cellulosic material with a treating solution containing the polycarboxylic acid, the curing catalyst, a solvent and optionally a fabric softener. This may be done, for example, by immersing the material in a bath of the treating solution. The solvent used to prepare the treating solution is preferably water, although any inert volatile solvent in which the polycarboxylic acid and curing catalyst are soluble or uniformly dispersible can be used. The fabric softener, if present, should be an inert, emulsified nonionic or anionic material such as the usual nonionic polyethylene, polypropylene, or silicone softeners. After being thoroughly wet in the treating bath, the cellulosic material is passed between squeeze rolls to remove excess liquid, and is then oven-dried at any convenient temperature just sufficient to remove the solvent within the desired time. The material is then oven-cured at 150°–240° C. for 5 seconds to 30 minutes to cause cellulose esterification and crosslinking to occur. Alternatively the above drying step may be omitted, and the material can be flash-cured, to remove solvent at the same time that cellulose esterification and crosslinking take place. If desired, the cured material may subsequently be given a water rinse to remove unreacted reagent and curing catalyst, and may then be redried.

The polycarboxylic acids effective as cellulose crosslinking agents in the processes of this invention include aliphatic, alicyclic and aromatic acids either olefinically saturated or unsaturated with at least three and preferably more carboxyl groups per molecule or with two carboxyl groups per molecule if a carbon-carbon double bond is present alpha, beta to one or both carboxyl groups. An additional requirement is that to be reactive in esterifying cellulose hydroxyl groups, a given carboxyl group in an aliphatic or alicyclic polycarboxylic acid must be separated from a second carboxyl group by no less than 2 carbon atoms and no more than three carbon atoms. In an aromatic acid, a carboxyl group must be ortho to a second carboxyl group if the first carboxyl is to be effective in esterifying cellulosic hydroxyl groups. It appears from these requirements that for a carboxyl group to be reactive, it must be able to form a cyclic 5-or 6-membered anhydride ring with a neighboring carboxyl group in the polycarboxylic acid molecule. Where two carboxyl groups are separated by a carbon-carbon double bond or are both connected to the same ring, the two carboxyl groups must be in the cis configuration relative to each other if they are to interact in this manner.

The aliphatic or alicyclic polycarboxylic acid may also contain an oxygen or sulfur atom in the chain or ring to which the carboxyl groups are attached.

In aliphatic acids containing three or more carboxyl groups per molecule, a hydroxyl group attached to a carbon atom alpha to a carboxyl group does not interfere with the esterification and crosslinking of cellulose by the acid, although the presence of the hydroxyl group causes a noticeable yellowing of the material during the heat cure. Such an aloha-hydroxy acid is suitable for durable press finishing of suitably dyed cotton fabric, since the color of the dye conceals the discoloration caused by the hydroxyl group. Fabric discoloration is similarly observed with an unsaturated acid having an olefinic double bond that is not only alpha, beta to one carboxyl group but also beta, gamma to a second carboxyl group.

The discoloration produced in a white cellulosic material by crosslinking it with an alpha-hydroxy acid such as citric acid can be removed by impregnating the discolored material with an aqueous solution containing from 0.5% to 5% by weight of a decolorizing agent selected from the group consisting of magnesium monoperoxyphthalate, sodium perborate, sodium tetraborate, boric acid, sodium borohydride, sodium hypochlorite, and hydrogen chloride. The material is immersed in the solution of decolorizing agent and soaked for 5 to 120 minutes at ambient temperature or if necessary in such a solution warmed to a temperature not exceeding 60° C. The material is subsequently rinsed with water to remove excess chemicals and solubilized colored products, and then is dried.

Examples of specific polycarboxylic acids which fall within the scope of this invention are the following: maleic acid; citraconic acid also called methylmaleic acid citric acid also known as 2-hydroxy-1,2,3-propanetricarboxylic acid: itaconic acid also called methylenesuccinic acid: tricarballylic acid also known as 1,2,3-propanetricarboxylic acid trans-aconitic acid also known as trans-1-propene-1,2,3-tricarboxylic acid 1,2,3,4-butanetetracarboxylic acid all-cis-1,2,3 4-cyclopentanetetracarboxylic acid mellitic acid also known as benzenehexacarboxylic acid; oxydisuccinic acid also known as 2,2'-oxybis(butanedioic acid); thiodisuccinic acid; and the like.

The concentration of polycarboxylic acid used in the treating solution may be in the range of 1% to 20% by weight depending on the solubility of the polycarboxylic acid and the degree of cellulose crosslinking required as determined by the level of wrinkle resistance, smooth drying properties and shrinkage resistance desired.

In the examples to be given, the properties of the treated fabrics were measured by standard test methods, which were as follows: conditioned and wet wrinkle recovery angle-ASTM method D-1295-67, Elmendorf tearing strength-ASTM Method D-1424-63, strip breaking strength-AsTM Method D-1682.64, stiffness by the Tinius Olsen Method (Federal Test 191, Method 5202), durable press appearance ratings-AATCC Method 124–1967. The machine launderings were at a wash temperature of 50° C. The pH of the wash water was 9.8 due to use of standard AATCC detergent. Thus the laundering was at high alkalinity in order to test the durability to alkaline detergent of the durable press finishes of this invention.

In the following examples, all parts and percentages are by weight. The examples are only illustrative of the processes of the present invention. Changes and modifications in the specifically described embodiments can be carried out without departing from the scope of the invention which is intended to be limited only by the scope of the claims.

EXAMPLE 1

Sodium Hypophosphite as a Curing Catalyst for the Durable Press Finishing of Cotton Fabric with 1,2,3,4-Butanetetracarboxylic Acid An aqueous treating bath was prepared containing 6.3% by weight of 1,2,3,4-butanetetracarboxylic acid, a specified concentration of sodium hypophosphite monohydrate as curing catalyst, and 1% emulsified nonionic polyethylene which served as a fabric softener. An all-cotton desized, scoured and bleached 80×80 printcloth weighing 3.2 oz/yd$^2$ was thoroughly wetted by immersion in this treating bath, was passed between the rolls of a wringer, was again immersed in the treating bath, and was again passed through the wringer, the pressure of the wringer rolls being sufficient to give a wet pickup of 116%–134% of aqueous mixture on the fabric based on the original weight of fabric sample.

The fabric was then dried in a forced draft oven at 85° C. for 5 minutes, and was heat-cured in a second forced draft oven at a specified temperature for a stated time. The fabric was subsequently rinsed for 30 minutes in hot running water to remove any unreacted agents, and was oven dried at 85° C. for 5 minutes.

The durable press appearance rating of the treated fabric after one machine laundering and tumble drying cycle was determined as a function of the curing temperature and time, as well as the concentration of sodium hypophosphite monohydrate used. The results appear in Table I.

TABLE I

| Conc. $NaH_2PO_2.H_2O$ Catalyst | Cure Temp. | Cure Time | Fabric Weight Gain | Durable Press Rating | Fabric Color Before Rinse | Fabric Color After Rinse |
|---|---|---|---|---|---|---|
| 0.0% | 180° C. | 90 sec. | 7.8% | 2.9 | pale tan | faint tan |
| 0.4 | 180 | 90 | 10.0 | 4.1 | pale tan | faint yellow |
| 0.8 | 180 | 90 | 9.3 | 4.4 | faint yellow | white |
| 1.6 | 180 | 90 | 9.9 | 4.6 | off-white | white |
| 3.3 | 180 | 90 | 9.9 | 4.8 | white | white |
| 6.5 | 180 | 90 | 12.1 | 4.5 | white | white |
| 6.5[a] | 180 | 90 | 9.9 | 4.7 | white | white |
| 6.5 | 180 | 45 | 11.8 | 4.6 | white | white |
| 6.5 | 180 | 30 | 10.8 | 4.1 | white | white |
| 6.5 | 195 | 30 | 11.1 | 4.6 | white | white |
| DMDHEU[B] | 160 | 180 | 7.3 | 4.6 | off-white | off-white |
| 6.5[c] | 180 | 90 | 0.9 | 1.8 | white | white |
| Untreated fabric | | | | 1.5 | white | white |

[a]No polyethylene present as fabric softener in this run.
[b]A treating bath containing 6% dimethyloldihydroxyethyleneurea as the cellulose crosslinking agent, 1.5% $MgCl_2.6H_2O$ as catalyst, and 1.0% polyethylene was used in this run.
[c]The treating bath contained sodium hypophosphite and polyethylene but no 1,2,3,4-butanetetracarboxylic acid.

Fibers were removed from cotton fabric which had been treated as above with 6.3% 1,2,3,4-butanetetracarboxylic acid and 6.5: sodium hypophosphite monohydrate with heat curing at 180° for 90 seconds. The fibers were completely insoluble in 1.0M aqueous cupriethylenediamine hydroxide solution even after 1 hour. Fibers from untreated fabric dissolved within 30 seconds in this solution. The results show the cotton cellulose was highly crosslinked after being heat-cured with 1,2,3,4-butanetetracarboxylic acid and the sodium hypophosphite catalyst. The same positive test for crosslinking was obtained after the heat cure when 1% emulsified polyethylene was also present with the butanetetracarboxylic acid and sodium hypophosphite used to treat the fabric.

A number of textile properties were measured on the treated fabric samples prior to machine laundering, and are compared in Table II.

TABLE II

| Conc. $NaH_2PO_2.H_2O$ Catalyst | Cure | Wrinkle Recovery Angle (W + F) Cond. | Wrinkle Recovery Angle (W + F) Wet | Warp Tear Strength Retained | Warp Break Strength Retained | Stiffness, Bending Moment (Warp) |
|---|---|---|---|---|---|---|
| 6.5% | 180°/90 sec | 300° | 268° | 60% | 54% | $5.8 \times 10^{-4}$ in.-lb. |
| 6.5 | 180/45 | 293 | 267 | 58 | 57 | 4.3 |
| 6.5 | 195/30 | 288 | 276 | 54 | 59 | 4.3 |
| DMDHEU[a] | 160/180 | 303 | 271 | 54 | 44 | 4.2 |
| Untreated fabric | | 200 | 141 | (100) | (100) | 4.8 |

[a]The treating bath contained 6% dimethyloldihydroxyethyleneurea, 1.5% $MgCl_2.6HO$ and 1.0% polyethylene in place of butanetetracarboxylic acid, sodium hypophosphite and polyethylene.

The data show that sodium hypophosphite induced very fast curing reactions of 1,2,3,4-butanetetracarboxylic acid with cotton to impart essentially the same durable press appearance ratings and wrinkle recovery angles to fabric as a conventional finishing agent, DMDHEU, and did so with less breaking and tearing strength loss in the fabric then did the conventional agent. Other properties of the two finishers were comparable.

EXAMPLE 2

Comparison of Sodium Hypophosphite and Disoium Phosphite with other Catalysts for Durable Press Finishing of Cotton Fabric with 1,2,3,4-Butanetetracarboxylic Acid An aqueous treating bath was prepared containing 6.3% by weight of 1,2,3,4-butanetetracarboxylic acid, a specified catalyst, and 1% emulsified nonionic polyethylene which served as a fabric softener. An all-cotton desized, scoured and bleached 80×80 printcloth weighing 3.2 oz/yd$^2$ was treated with this mixture by the procedure of Example 1. The heat cure was at 180° C. for 90 seconds. After the final 30 minute water rinse and oven drying, the treated fabric samples were repeatedly machine washed and tumble dried, and durable press appearance ratings were determined after a specified number of wash-and-tumble dry cycles. The ratings appear in Table III as a function of the number of cycles carried out and the type of catalyst used.

TABLE III

| Curing Catalyst | Catalyst Normality[a] As A Base | Durable Press Appearance Rating After Repeated Washing and Tumble Drying Cycles No. Cycles (1) | (5) | (20) | (30) | (35) | (40) | (65) |
|---|---|---|---|---|---|---|---|---|
| 6.5% $NaH_2PO_2.H_2O$ | 0.61 equiv./liter | 4.5 | 4.4 | 4.6 | 4.5 | 4.5 | | |
| 6.6% $Na_2HPO_3.5H_2O$ | 0.61 | 4.5 | 4.2 | 4.0 | 4.3 | | 4.1 | 4.0 |
| 4.4% $Na_2HPO_4$ | 0.62 | 4.2 | 4.0 | 3.8 | 3.7 | | 3.4 | 3.6 |
| 7.7% $Na_3PO_4.12H_2O$ | 0.61 | 3.8 | | | | | | |
| 5.8% $Na_3PO_4.12H_2O$ | 0.46 | 4.3 | 3.9 | 3.9 | 3.8 | 3.5 | 3.5 | 3.6 |
| 2.9% $Na_3PO_4.12H_2O$ | 0.23 | 4.0 | 3.9 | | | | | |

TABLE III-continued

| Curing Catalyst | Catalyst Normality[a] As A Base | Durable Press Appearance Rating After Repeated Washing and Tumble Drying Cycles No. Cycles (1) | (5) | (20) | (30) | (35) | (40) | (65) |
|---|---|---|---|---|---|---|---|---|
| 3.3% $Na_2CO_3$ | 0.60 | 2.9 | 2.8 | 3.2 | 2.9 | | | |
| 1.6% $Na_2CO_3$ | 0.30 | 3.8 | 3.7 | 3.5 | 3.7 | 3.4 | 3.5 | 3.5 |
| 0.8% $Na_2CO_3$ | 0.15 | 4.0 | 3.7 | | | | | |

[a]Numerically equal to the concentration of sodium ions available from the catalyst, in gram-ion/liter. The normality of 1,2,3,4-butanetetracarboxylic acid was 1.08 equiv./liter in the treating bath.

The data show that the use of the sodium hypophosphite and disodium phosphite catalysts of the present invention resulted in higher initial durable press appearance ratings, and greater durability of the smooth drying finish to repeated laundering, than was obtained with strongly alkaline trisodium phosphate and sodium carbonate catalysts. This was true when the catalysts were compared at the same normality as bases, and also when compared at the concentrations of maximum effectiveness. The teaching of Rowland et al., that the effectiveness of a given alkali metal salt as a curing agent for this type of cellulose crosslinking depends solely on the salt being a strong base capable of forming a soluble, partial salt of polybasic acid in an effective concentration., proved inapplicable to sodium hypophosphite. The latter is a very weak base derived from an acid much stronger than 1,2,3,4-butanetetracarboxylic acid, and is relatively ineffective in forming the partial sodium salts of 1,2,3,4-butanetetracarboxylic acid. The importance of catalyst structure rather than catalyst basicity is also evident in comparing disodium phosphite and disodium phosphate, the former being the more effective catalyst, even though appreciably less alkaline than the latter.

EXAMPLE 3

Comparison of Various Polycarboxylic Acids as Durable Press Finishing Agents for Cotton Fabric with Sodium Hypophosphite or Disodium Phosphite as the Curing Catalyst An aqueous treating bath was prepared containing a specified concentration of a given polycarboxylic acid, a stated catalyst, and 1% emulsified nonionic polyethylene which served as a fabric softener. An all-cotton desized, scoured and bleached 80×80 printcloth weighing 3.2 oz/yd$^2$ was thoroughly wetted by immersion in this treating bath, was passed between the rolls of a wringer, was again immersed in the treating bath, and was again passed through the wringer, the pressure of the wringer rolls being sufficient to give a wet pickup of 112%–126% of aqueous mixture on the fabric, based on the original weight of fabric sample.

The fabric was then dried in a forced draft oven at 85° C. for 5 minutes, and was heat-cured in a second forced draft oven at 180° C. for 90 seconds. The fabric was subsequently rinsed for 30 minutes in hot running water to remove any unreacted agents, and was oven dried at 85° C. for 5 minutes.

The durable press appearance ratings were determined after varying numbers of machine wash-and-tumble dry cycles, and are shown in Table IV as a function of the particular polycarboxylic acid and catalyst used.

TABLE IV

| Polycarboxylic Acid | Catalyst | Fabric Weight Gain | Durable Press Ratings After Multiple Laundering Cycles No. Cycles (1) | (5) | (10) | (20) | (30) |
|---|---|---|---|---|---|---|---|
| 9.5% 1,2,3-propanetricarboxylic acid[a] | 6.5% $NaH_2PO_2.H_2O$ | 11.0% | 4.6 | 4.7 | 4.4 | 4.6 | 4.6 |
| | 6.6% $Na_2HPO_3.5H_2O$ | 13.2 | 4.4 | 3.9 | 3.8 | 3.7 | 3.6 |
| | 7.7% $Na_3PO_4.12H_2O$ | 12.4 | 3.9 | | | | |
| | 3.3% $Na_2CO_3$ | 11.0 | 3.7 | | | | |
| | 1.6% $Na_2CO_3$ | 12.5 | 3.9 | | | | |
| | 0.8% $Na_2CO_3$ | 10.6 | 3.6 | | | | |
| | None | 7.1 | 2.2 | | | | |
| 10.4% citric Acid | 6.5% $NaH_2PO_2.H_2O$ | 12.3 | 4.7 | 4.5 | 4.0 | 3.8 | 3.7 |
| | 4.4% $Na_2HPO_4$ | 12.9 | 3.5 | 3.4 | | | |
| | 5.8% $Na_3PO_4.12H_2O$ | 12.0 | 3.5 | 3.5 | | | |
| | 4.0% $Na_3C_6H_5O_7.2H_2O$[b] | 13.9 | 3.5 | | | | |
| | None | 8.3 | 2.7 | | | | |
| 9.4% trans-1-propane-1,2,3-tricarboxylic acid[c] | 2.9% $NaH_2PO_2.H_2O$ | 9.5 | 4.3 | 4.3 | 4.0 | 3.9 | 3.5 |
| | None | 5.7 | 3.3 | | | | |
| 6.3% maleic Acid | 2.9% $NaH_2PO_2.H_2O$ | 10.7 | 3.4 | 3.5 | 3.0 | | |
| | None | 4.3 | 2.8 | | | | |
| 6.3% all-cis-1,2,3,4-cyclopentanetetracarboxylic acid | 6.5% $NaH_2PO_2.H_2O$ | 10.0 | 4.6 | 4.6 | 4.4 | 4.6 | 4.6 |
| | 6.6% $Na_2HPO_3.5H_2O$ | 11.4 | 4.4 | 3.8 | 4.0 | 3.6 | 3.6 |
| | None | 8.7 | 2.7 | | | | |
| 7.2% thiodisuccinic acid | 6.5% $NaH_2PO_2.H_2O$ | 11.0 | 4.4 | 4.7 | | | |

TABLE IV-continued

| Polycarboxylic Acid | Catalyst | Fabric Weight Gain | Durable Press Ratings After Multiple Laundering Cycles No. Cycles (1) | (5) | (10) | (20) | (30) |
|---|---|---|---|---|---|---|---|
| | None | 7.1 | 2.9 | | | | |
| 6.2% benzenehexa-carboxylic acid[d] | 6.5% $NaH_2PO_2.H_2O$ | 10.9 | 4.4 | 4.3 | 4.4 | | |
| | None | 11.0 | 3.7 | 4.0 | 3.9 | | |
| 6% DMDHEU[e] | | 7.3 | 4.6 | 4.7 | 4.8 | 4.8 | 4.8 |
| Untreated fabric | | | 1.5 | 1.4 | 1.4 | 1.6 | 1.5 |

[a]Tricarballyic acid is the common name of this acid.
[b]Trisodium citrate dihydrate.
[c]trans-Aconitic acid in the common name of this acid.
[d]Mellitic Acid in the common name of this acid.
[e]Same run with dimethyloldihydroxyethyleneurea as in Tables I and II.

Other textile properties of certain of the above treated fabrics were determined prior to machine laundering, and are shown in Table V. The curing catalyst was 6.5% sodium hypophosphite monohydrate in these runs.

TABLE V

| Polycarboxylic Acid | Wrinkle Recovery Angle (W + F Cond. | Wet | Warp Tear Strength Retained | Wrap Break Strength Retained | Stiffness, Bending Moment (Warp) |
|---|---|---|---|---|---|
| 9.5% 1,2,3-propane-tricarboxylic acid | 300° | 274° | 61% | 57% | $5.3 \times 10^{-4}$in.-lb. |
| 10.4% citric acid[a] | 295 | 251 | 62 | 56 | 4.8 |
| 9.4% trans-1-propene-1,2,3-tricarboxylic acid[b] | 296 | 238 | 72 | 58 | 3.9 |
| 6.3% all-cis-1,2,3,4-cyclopentanetetracarboxylic acid | 298 | 262 | 68 | 54 | 4.9 |
| 6% DMDHEU[c] | 303 | 271 | 54 | 44 | 4.2 |
| Untreated fabric | 200 | 141 | (100) | (100) | 4.8 |

[a]The treated fabric had a light yellow discoloration after the hot water rinse. The durable press rating was 4.7 with or without polyethylene softener.
[b]This agent caused a deep yellow discoloration in the rinsed fabric.
[c]Same run with dimethyloldihyroxyethyleneurea as in Tables I and II.

The data show aliphatic, alicyclic and aromatic polycarboxylic acids having 2–6 carboxyl groups per molecule impart wrinkle resistance and smooth drying properties to cotton fabric when heat cured on the fabric in the presence of an alkali metal phosphite or hypophosphite as a curing catalyst. The polycarboxylic acid used may also contain a carbon-carbon double bond or a hydroxyl group on a carbon atom attached to a carboxyl group in the molecule without eliminating the effectiveness in imparting durable press properties. The appearance of a yellow discoloration in white fabric treated with polycarboxylic acids containing a double bond or hydroxyl group can be concealed by afterdyeing the fabric with a basic dye, or by the use of fabric suitably dyed prior to treatment. A carboxyalkylthio substituent on a carbon atom attached to a carboxyl group in the polycarboxylic acid had no adverse effect on fabric whiteness, and was beneficial to the smooth drying properties.

The use of polycarboxylic acids as durable press finishing agents with sodium hypophosphite as the curing agent resulted in durable press appearance ratings and conditioned wrinkle recovery angles comparable to those imparted by the conventional durable press finishing agent, DMDHEU, but with consistently less loss of tearing and breaking strength than was produced by DMDHEU.

EXAMPLE 4

Polyphosphate Salts as Curing Catalysts for the Durable Press Finishing of Cotton Fabric with 1,2,3,4-Butanetetracarboxylic Acid On all-cotton desized, scoured and bleached 80×80 printcloth weighing 3.2 oz/yd$^2$ was treated as in Example 1, except that in place of sodium hypophosphite, an alkali metal polyphosphate was used as the curing catalyst. The heat cure was at 180° C. for 90 seconds.

The durable press appearance rating of the treated fabric was determined as a function of the curing catalyst and the number of laundering cycles carried out on the treated sample. The results are given in Table VI. Runs with disodium phosphate, trisodium phosphate and sodium carbonate as catalysts are included for comparison.

TABLE VI

| Curing Catalyst | Catalyst Normality[a] As A Base | Fabric Weight Gain | Durable Press Ratings After Multiple Laundering Cycles No. Cycles: (1) | (30) | (40) | (50) |
|---|---|---|---|---|---|---|
| 3.4% $Na_2H_2P_2O_7$[b] | 0.31 equiv/liter | 12.0% | 4.4 | 3.8 | 3.9 | 3.9 |
| 4.1% $Na_4P_2O_7$[c] | 0.62 | 11.8 | 4.3 | 3.9 | 3.8 | 4.0 |

TABLE VI-continued

| Curing Catalyst | Catalyst Normality[a] As A Base | Fabric Weight Gain | Durable Press Ratings After Multiple Laundering Cycles No. Cycles: (1) | (30) | (40) | (50) |
|---|---|---|---|---|---|---|
| 5.6% $Na_5P_3O_{10}$[d] | 0.76 | 12.2 | 4.3 | 3.9 | 3.8 | 4.0 |
| 4.1% $(NaPO_3)^6$[e] | 0.40 | 10.6 | 4.3 | 4.0 | 3.9 | |
| 6.3% $(NaPO_3)^6$[e] | 0.62 | 11.1 | 4.3 | 3.9 | 4.0 | |
| 4.4% $Na_2HPO_4$ | 0.62 | 12.0 | 4.2 | 3.7 | 3.4 | 3.5 |
| 7.7% $Na_3PO_4.12H_2O$ | 0.61 | 10.8 | 3.8 | | | |
| 5.8% $Na_3PO_4.12H_2O$ | 0.46 | 10.7 | 4.3 | 3.8 | 3.5 | 3.6 |
| 3.3% $Na_2CO_3$ | 0.60 | 9.1 | 2.9 | 2.9 | | |
| 1.6% $Na_2CO_3$ | 0.30 | 9.6 | 3.8 | 3.7 | 3.5 | 3.7 |
| 0.8% $Na_2CO_3$ | 0.15 | 9.2 | 4.0 | 3.7 | | |

[a]See footnote of Table III.
[b]Disodium acid pyrophosphate.
[c]Tetrasodium pyrophosphate
[d]Pentasodium tripolyphosphate.
[e]Sodium hexametaphosphate.

The data show that use of the polyphosphate catalysts led to higher initial durable press ratings than were obtainable with sodium carbonate, and after 40 launderings of the treated fabrics, durable press ratings were higher with polyphosphates as curing catalysts, than when disodium phosphate or trisodium phosphate were used.

Other textile properties were determined on the treated samples prior to machine laundering. As shown in Table VII, the polyphosphate catalysts gave wrinkle recovery and strength retention equivalent to those obtainable with the other catalysts tested.

TABLE VII

| Curing Catalyst | Wrinkle Recovery Angle (W + F) Cond. | Wet | Warp Tear Strength Retained | Warp Break Strength Retained | Stiffness Bending Moment (Warp) |
|---|---|---|---|---|---|
| 4.1% $Na_4P_2O_7$ | 284° | 238° | 65% | 60% | $4.7 \times 10^{-4}$in.-lb. |
| 5.6% $Na_5P_3O_{10}$ | 281 | 232 | 65 | 56 | 5.0 |
| 4.4% $Na_2HPO_4$ | 285 | 237 | 65 | 55 | 4.3 |
| 5.8% $Na_3PO_4.12H_2O$ | 281 | 226 | 66 | 61 | 4.0 |
| Untreated fabric | 200 | 141 | (100) | (100) | 4.8 |

EXAMPLE 5

Alkali Metal Dihydrogen Phosphates as Curing Catalysts for the Durable Press Finishing of Cotton Fabric with 1,2,3,4-Butanetetracarboxylic Acid An all-cotton desized, scoured and bleached 80×80 printcloth weighing 3.2 oz./yd$^2$ was treated as in Example 1, except that in place of sodium hypophosphite, an alkali metal dihydrogen phosphate was used as the curing catalyst. The heat cure was at 180° C. for 90 seconds.

The durable press appearance rating of the treated fabric was determined as a function of the curing catalyst and the number of laundering cycles carried out on the treated samples. The results are given in Table VIII.

TABLE VIII

| Curing Catalyst | Catalyst Normality[a] As A Base | Fabric Weight Gain | Durable Press Ratings After Multiple Laundering Cycles No. Cycles: (1) | (30) | (40) | (50) | (60) | (65) |
|---|---|---|---|---|---|---|---|---|
| 3.2% $LiH_2PO_4$[b] | 0.31 equiv/liter | 10.8% | 4.2 | 3.9 | 3.9 | 4.0 | 3.8 | 3.9 |
| 4.2% $NaH_2PO_4.H_2O$ | 0.30 | 10.7 | 4.4 | 3.9 | 3.7 | 3.6 | 3.8 | 3.8 |
| 4.2% $KH_2PO_4$ | 0.31 | 11.2 | 4.5 | 3.8 | 3.9 | 4.0 | 3.9 | 3.9 |
| 4.4% $Na_2HPO_4$ | 0.62 | 11.1 | 4.2 | 3.7 | 3.4 | 3.5 | 3.6 | 3.6 |
| 7.7% $Na_3PO_4.12H_2O$ | 0.61 | 10.8 | 3.8 | | | | | |
| 5.8% $Na_3PO_4.12H_2O$ | 0.46 | 10.7 | 4.3 | 3.8 | 3.5 | 3.6 | 3.5 | 3. |
| 3.3% $Na_2CO_3$ | 0.60 | 9.1 | 2.9 | 2.9 | | | | |
| 1.6% $Na_2CO_3$ | 0.30 | 9.6 | 3.8 | 3.7 | 3.5 | 3.7 | 3.6 | 3. |
| 0.8% $Na_2CO_3$ | 0.15 | 9.2 | 4.0 | 3.7 | | | | |
| Untreated fabric | | | 1.5 | | | | | 1. |

[a]See footnote of Table III.
Formed in situ from 0.73% LiOH + 3.0% $H_3PO_4$ in the treating bath.

Use of alkali metal dihydrogen phosphates as curing catalysts led to higher initial durable press appearance ratings than were obtainable with sodium carbonate catalysis. Moveover use of the former catalyst in place of disodium phosphate, trisodium phosphate or sodium carbonate led to increased durability of the finish to laundering as seen from the durable press appearance ratings after 60–65 cycles of machine washing and tumble drying.

Other textile properties imparted by use of sodium dihydrogen phosphate as catalyst appear in Table IX as a function of curing temperature.

TABLE IX

| Cure Temp./Time | Wrinkle Recovery Angle (W + F) Cond. | Wet | Warp Tear Strength Retained | Warp Break Strength Retained | Stiffness, Bending Moment (Warp) |
|---|---|---|---|---|---|
| 170° C./90 sec. | 283° | 234° | 59% | 55% | $4.8 \times 10^{-4}$in.-lb. |
| 180/90 | 300° | 254 | 55 | 51 | 4.8 |
| 6% DMDHEU[b] | 303 | 271 | 54 | 44 | 4.2 |
| Untreated fabric | 200 | 141 | (100) | (100) | 4.8 |

[a]The durable press appearance rating was 4.1 after 1 laundering cycle and 3.5 after 65 cycles.
[b]See Table II for formulation and cure.

The data show that the use of sodium dihydrogen phosphate as curing catalyst results in higher breaking strength retention in the treated cotton fabric than when DMDHEU is used to impart a comparable conditioned wrinkle recovery angle.

EXAMPLE 6

Sodium Dihydrogen Phosphate as Curing Catalyst for the Durable Press Finishing of Cotton Fabrics with 1,2,3,4-Butanetetracarboxylic Acid without Fabric Softener An aqueous treating bath was prepared containing 6.3% 1,2,3,4-butanetetracarboxylic acid and sodium dihydrogen phosphate in a range of concentrations as the curing catalyst. An all-cotton desized, scoured and bleached 80×80 printcloth weighing 3.2 oz/yd$^2$ was thoroughly wetted by immersion in this treating bath, was passed between the rolls of a wringer, was again immersed in the treating bath, and was again passed through the wringer, the pressure of the wringer rolls being sufficient to give a wet pickup of 90–100% of aqueous mixture on the fabric, based on the original weight of fabric sample. The fabric was then dried in a forced draft oven at 85 ° C. for 5 minutes, and was heat-cured in a second forced draft oven at 180° C. for 90 seconds. The fabric was subsequently machine laundered and tumble dried. A sample finished with 5% DMDHEU and a 1.8% magnesium chloride hexahydrate-citric acid catalyst in a 20:1 gram formula weight (gfw) ratio was included as a control. The textile properties after one laundering cycle are given in Table X.

Property improvements are realized over the whole range of catalyst concentrations; however optimum performance occurred at concentrations of 3.5% or higher.

EXAMPLE 7

1,2,3,4-Butanetetracarboxylic Acid/Sodium Dihydrogen Phosphate Systems for Durable Press Finishing of All Cotton Fabrics without Fabric Softener An aqueous treating bath was prepared containing a given concentration of 1,2,3,4-butanetetracarboxylic acid and sodium dihydrogen phosphate in an agent to catalyst gfw ratio of 1:1.15. An all-cotton desized, scoured and bleached 80×80 printcloth weighing 3.2 oz/yd$^2$ was thoroughly wetted by immersion in this treating bath, was passed between the rolls of a wringer was again immersed in the treating bath, and was again passed through the wringer, the pressure of the wringer rolls being sufficient to give a wet pickup of 90–100% of aqueous mixture on the fabric, based on the original weight of fabric sample. The fabric was then dried in a forced draft oven at 85° C. for 5 minutes, and was heat-cured in a second forced draft oven at 180° C. for 90 seconds. The fabric was subsequently machine laundered and tumble dried. A sample finished with 5% DMDHEU and a 1.8% magnesium chloride hexahydrate-citric acid catalyst in a 20:1 gfw ratio was included as a control. The textile properties after one laundering cycle are given in Table XI.

TABLE X

| $NaH_2PO_4.H_2O$, % in pad bath | Durable press rating | Wrinkle Recovery Angle, cond., deg, (W + F) | Tear strength retained, % | Break strength retained, % |
|---|---|---|---|---|
| 6.3 | 4.2 | 256 | 44 | 41 |
| 5.7 | 4.0 | 246 | 41 | 42 |
| 4.9 | 3.3 | 248 | 41 | 39 |
| 4.3 | 3.3 | 251 | 42 | 43 |
| 3.5 | 3.2 | 255 | 45 | 42 |
| 2.8 | 3.1 | 243 | 43 | 40 |
| 2.1 | 2.8 | 249 | 48 | 41 |
| 1.4 | 2.6 | 243 | 48 | 44 |
| DMDHEU/$MgCl_2$-citric acid | | | | |
| — | 4.0 | 261 | 42 | 31 |

TABLE XI

| BTCA % in pad bath | Durable press rating | Wrinkle Recovery Angle, cond., deg, (W + F) | Tear strength retained, % | Break strength retained, % |
|---|---|---|---|---|
| 12 | 4.8 | 286 | 43 | 39 |
| 10 | 4.8 | 275 | 45 | 40 |
| 8 | 4.3 | 260 | 47 | 39 |
| 6 | 4.3 | 264 | 50 | 42 |
| 4 | 3.9 | 245 | 50 | 40 |
| 2 | 2.7 | 230 | 63 | 54 |
| DMDHEU/$MgCl_2$-citric acid | | | | |

TABLE XI-continued

| BTCA % in pad bath | Durable press rating | Wrinkle Recovery Angle, cond., deg, (W + F) | Tear strength retained, % | Break strength retained, % |
|---|---|---|---|---|
| — | 4.0 | 261 | 42 | 31 |

Property improvements are realized from a range of application levels. However, greatest improvements occur when the 1,2,3,4butanetetracarboxylic acid is applied at concentrations of 6% or higher.

EXAMPLE 8

Dihydrogen Phosphate, Polyphosphate and Hypophosphite Salts as Curing Catalysts for the Durable Press Finishing of Cotton Fabric with Citric Acid without Softener An aqueous treating bath was prepared containing 6.9% citric acid, and a stated catalyst. An all-cotton desized, scoured and bleached 80×80 printcloth weighing 3.2 oz/yd$^2$ was thoroughly wetted by immersion in this treating bath, was passed between the rolls of a wringer, was again immersed in the treating bath, and was again passed through the wringer, the pressure of the wringer rolls being sufficient to give a wet pickup of 90–100% of aqueous mixture on the fabric, based on the original weight of fabric sample. The fabric was then dried in a forced draft oven at 85° C. for 5 minutes, and was heat cured in a second draft oven at 180° C. for 90 seconds, causing some fabric yellowing. The fabric was subsequently machine laundered and tumble dried. Textile properties after the one laundering cycle are reported in Table XII.

TABLE XII

| Catalyst (% in pad bath) % | Fabric weight gain, % | Durable press rating | Wrinkle Recovery Angle, cond., deg, (W + F) | Tear strength retained, % | Break strength retained, |
|---|---|---|---|---|---|
| $NaH_2PO_4.H_2O$ | | | | | |
| (11.4) | 5.1 | 3.7 | 235 | 42 | 40 |
| (8.6) | 4.8 | 3.7 | 237 | 47 | 44 |
| (6.7) | 3.9 | 3.7 | 237 | 47 | 42 |
| (5.7) | 4.2 | 3.8 | 236 | 42 | 38 |
| (4.2) | 4.1 | 3.5 | 230 | 45 | 39 |
| (2.9) | 1.9 | 2.8 | 239 | 46 | 38 |
| $(NaPO_4)_6$ | | | | | |
| (11.0) | 5.7 | 3.5 | 231 | 59 | 53 |
| (6.6) | 5.6 | 3.5 | 235 | 48 | 47 |
| (4.4) | 4.2 | 3.5 | 235 | 51 | 47 |
| (2.2) | 3.8 | 3.0 | 237 | 51 | 46 |
| $Na_4P_4O_{12}$ | | | | | |
| (10.0) | 7.4 | 3.5 | 231 | 60 | 59 |
| (6.5) | 6.0 | 3.5 | 236 | 59 | 53 |
| (4.5) | 4.4 | 3.3 | 241 | 53 | 48 |
| (2.5) | 3.8 | 3.0 | 236 | 52 | 46 |
| (8.0) | 3.0 | 2.0 | 212 | 73 | 62 |
| (4.8) | 2.8 | 1.5 | 226 | 65 | 57 |
| (3.2) | 2.9 | 2.0 | 224 | 64 | 55 |
| (2.4) | 3.0 | 1.5 | 232 | 59 | 53 |
| $H_2NaO_2P.H_2O$ | | | | | |
| (5.9) | 3.3 | 3.5 | 245 | 49 | 43 |
| (4.9) | 3.3 | 3.5 | 248 | 49 | 47 |
| (3.9) | 3.4 | 3.5 | 251 | 52 | 45 |
| (2.9) | 2.9 | 3.5 | 249 | 52 | 48 |
| Untreated fabric | | 1.0 | 177 | 100 | 100 |

Referring to the catalysts in the order in which listed in Table XII, sodium dihydrogen phosphate, sodium hexametaphosphate, sodium tetrametaphosphate, tetrasodium pyrophosphate, and sodium hypophosphite curing catalysts for durable press finishing of cotton fabric with citric acid improved the appearance properties over that of untreated cotton. Greatest improvements were obtained when sodium dihydrogen phosphate, sodium hexametaphosphate, sodium tetrametaphosphate and sodium hypophosphite were the curing catalysts. Improvements were realized over a range of catalyst concentrations.

EXAMPLE 9

Sodium Hypophosphite as a Curing Catalyst for the Durable Press Finishing of Cotton Fabric with Citric Acid without Fabric Softener Aqueous treating baths were prepared containing citric acid in a range of concentrations and sodium hypophosphite curing catalyst as 50% of agent weight. An all-cotton desized, scoured and bleached 80×80 printcloth weighing 3.2 oz/yd$^2$ was thoroughly wetted by immersion in the treating bath, was passed between the rolls of a wringer, was again immersed in the treating bath, and was again passed through the wringer, the pressure of the wringer rolls being sufficient to give a wet pickup of 90–100% of aqueous mixture on the fabric, based on the original weight of fabric sample. The fabric was then dried in a forced draft oven at 85° C. for 5 minutes, and was heat-cured in a second forced draft oven at 180° C. for 90 seconds. The fabric was subsequently machine laundered and tumble dried. Textile properties after the one laundering cycle are reported in Table XIII.

TABLE XIII

| Citric acid (% in pad bath) % | Fabric weight gain, % | Durable press rating | Wrinkle Recovery Angle, cond., deg, (W + F) | Tear strength retained, % | Break strength retained, |
|---|---|---|---|---|---|
| 12 | 6.4 | 3.5 | 253 | 36 | 42 |
| 9 | 3.9 | 3.5 | 253 | 37 | 41 |
| 7 | 3.3 | 3.5 | 249 | 42 | 42 |
| 5 | 1.3 | 3.3 | 241 | 42 | 45 |

Sodium hypophosphite, used as a curing catalyst for citric acid, produced durable press properties in cotton fabric.

EXAMPLE 10

Removal of Discoloration from Citric Acid-Treated Fabric

An aqueous treating bath was prepared containing 7% by weight of citric acid and 4.2% by weight of sodium dihydrogen phosphate monohydrate in the absence of softener. An all-cotton desized, scoured and bleached 80×80 printcloth weighing 3.2 oz/yd$^2$ was thoroughly wetted by immersion in the treating bath, was passed between the rolls of a wringer, was again immersed in the treating bath, and was again passed through the wringer, the pressure of the wringer rolls being sufficient to give a wet pickup of 90–100% of aqueous mixture on the fabric, based on the original weight of fabric sample. The fabric was then dried in a forced draft oven at 85° C. for 5 minutes, and was heat-cured in a second forced draft oven at 180° C. for 90 seconds. All of the samples were yellowed by the treatment. Representative treatments given the yellowed samples are listed in Table XIV. Treatments were carried out with a 50:1 liquid to fabric ratio for times ranging from 15 to 60 minutes at temperatures ranging from 20° (ambient) to 60° C. followed by three 5 min. rinses in deionized water and air drying. Evaluation of color removal was by CIE whiteness index measured on a Milton Roy Color scan II spectrophotometer. Results are shown in Table XIV.

TABLE XIV

| Bleaching Agent | Whiteness Index | Durable press rating |
|---|---|---|
| None | 41 | 3.9 |
| 1.5% Magnesium monoperoxyphthalate, 15 min, 40° C. | 69 | 3.5 |
| 1.5% Sodium perborate, 30 min, 40° C. | 66 | 2.3 |
| 1.5% Sodium tetraborate, 45 min, 20° C. | 55 | 3.0 |
| 1.5% Boric acid, 60 min, 20° C. | 59 | 3.8 |
| 1.5% Sodium borohydride, 15 min, 20° C. | 67 | 2.9 |
| 2% HCl, 20 min, 20° C. | 68 | 3.5 |
| 1% NaOCl, 15 min, 20° C. | 76 | 3.0 |
| DMDHEU treated fabric, no aftertreatment | 64 | 4.0 |

The results indicated that the yellow color could be substantially removed by treatment with the agents described in Table XIV.

All of the samples of Examples 8 and 9 that were treated with citric acid to produce durable press appearance properties in cotton fabric were yellowed by the treatment; the yellow color could be substantially removed by treatment with the agents described in Table XIV.

We claim:

1. Fibrous cellulosic material treated by a process comprising:

impregnating the fibrous cellulosic material with a treating solution containing a polycarboxylic acid and a curing catalyst;

the polycarboxylic acid being selected from the group consisting of: aliphatic, alicyclic and aromatic acids either olefinically saturated or unsaturated and having at least three carboxyl groups per molecule; aliphatic, alicyclic and aromatic acids having two carboxyl groups per molecule and having a carbon-carbon double bond located alpha, beta to one or both of the carboxyl groups; aliphatic acid either olefinically saturated or unsaturated and having at least three carboxyl groups per molecule and a hydroxyl group present on a carbon atom attached to one of the carboxyl groups of the molecule; and, said aliphatic and alicyclic acids wherein the acid contains an oxygen or sulfur atom in the chain or ring to which the carboxyl groups are attached; one carboxyl group being separated from a second carboxyl group by either two or three carbon atoms in the aliphatic and alicyclic acids; one carboxyl group being ortho to a second carboxyl group in the aromatic acids; and, one carboxyl group being in the cis configuration relative to a second carboxyl group where two carboxyl groups are separated by a carbon-carbon double bond or are both connected to the same ring;

the curing catalyst being selected from the group consisting of alkali metal hypophosphites, alkali metal phosphites, alkali metal polyphosphates and alkali metal dihydrogen phosphates; and, heating the material to produce esterification and crosslinking of the cellulose with the polycarboxylic acid in the material.

2. The fibrous cellulosic material of claim 1 wherein the alkali metal polyphosphates are selected from the group consisting of alkali metal trimetaphosphate, alkali metal tetrametaphosphate and alkali metal salts of acyclic polyphosphoric acids containing 2 to 50 phosphorous atoms per molecule.

3. The fibrous cellulosic material of claim 2 wherein the alkali metal salts of acyclic polyphosphoric acids are selected from the group consisting of disodium acid pyrophosphate, tetrasodium pyrophosphate, pentasodiun tripolyphosphate and sodium hexametaphosphate.

4. The fibrous cellulosic material of claim 1 wherein the polycarboxylic acid is selected from the group consisting of: maleic acid; citraconic acid; citric acid; itaconic acid; tricarballylic acid; trans-aconitic acid; 1,2,3,4-butanetetracarboxylic acid; all-cis-1,2,3,4-cyclopentanetetracarboxylic acid; mellitic acid; oxydisuccinic acid; and, thiodisuccinic acid.

5. The fibrous cellulosic material of claim 4 wherein the curing catalyst is selected from the group consisting of sodium hypophosphite and disodium phosphite.

6. The fibrous cellulosic material of claim 1 wherein the polycarboxylic acid is 1,2,3,4-butanetetracarboxylic acid and the curing catalyst is selected from the group consisting of sodium hypophosphite, disodium phosphite, disodium acid pyrophosphate, tetrasodium pyrophosphate, pentasodium tripolyphosphate, sodium hexametaphosphate, lithium dihydrogen phosphate, sodium dihydrogen phosphate and potassium dihydrogen phosphate.

7. The fibrous cellulosic material of claim 1 wherein the polycarboxylic acid is citric acid and the curing catalyst is selected from the group consisting of sodium dihydrogen phosphate, sodium hexametaphosphate, sodium tetrametaphosphate, tetrasodium pyrophosphate, sodium hypophosphite and disodium phosphite.

8. The fibrous cellulosic material of claim 1 wherein the polycarboxylic acid is maleic acid and the curing catalyst is an alkali metal hypophosphite.

9. The fibrous cellulosic material of claim 8 wherein the alkali metal hypophosphite is sodium hypophosphite.

10. The fibrous cellulosic material of claim 1 wherein the material contains not less than 30% by weight of cellulosic fibers selected from the group consisting of cotton, flax, jute, hemp, ramie and regenerated unsubstituted wood celluloses.

11. The fibrous cellulosic material of claim 10 wherein the cellulosic fibers are rayon.

12. The fibrous cellulosic material of claim 1 wherein the material is in a form selected from the group consisting of woven and non-woven textiles, fibers, linters, roving, silvers and paper.

13. The fibrous cellulosic material of claim 1 wherein the material is selected from the group consisting of woven and non-woven textiles.

14. The fibrous cellulosic material of claim 13 wherein the woven and non-woven textiles are yarns, woven fabrics or knit fabrics.

15. The fibrous cellulosic material of claim 1 wherein the material is a textile containing 50% to 100% cotton.

16. The fibrous cellulosic material of claim 1 wherein the material is an all-cotton fabric.

17. The fibrous cellulosic material of claim 1 wherein the concentration of curing catalyst in the treating solution is 0.3% to 11% by weight.

18. The fibrous cellulosic material of claim 1 wherein the concentration of the polycarboxylic acid in the treating solution is 1% to 20% by weight.

19. The fibrous cellulosic material of claim 1 and including impregnating the esterified and crosslinked material with a solution containing a decolorizing agent selected from the group consisting of magnesium monoperoxyphthalate, sodium perborate, sodium tetraborate, boric acid, sodium borohydride, sodium hypochlorite and hydrogen chloride.

20. The fibrous cellulosic material of claim 19 wherein the polycarboxylic acid is citric acid.

21. The fibrous cellulosic material of claim 1 and including impregnating the esterified and crosslinked material with a solution containing from 0.5% to 5% by weight of a decolorizing agent selected from the group consisting of magnesium monoperoxyphthalate, sodium perborate, sodium tetraborate, boric acid, sodium borohydride, sodium hypochlorite and hydrogen chloride, by immersing the material in the solution for 5 to 120 minutes at a temperature from ambient temperature to 60° C.

22. The fibrous cellulosic material of claim 21 wherein the polycarboxylic acid is citric acid.

23. The fibrous cellulosic material of claim 1 and including drying the material prior to or simultaneously with the esterification and crosslinking.

24. The fibrous cellulosic material of claim 1 wherein the heating of the material comprises heating at 150° to 240° C. for 5 seconds to 30 minutes.

25. Fibrous cellulosic material comprising cellulose oxydisuccinate.

26. Fibrous cellulosic material comprising cellulose thiodisuccinate.

* * * * *